US008888523B2

(12) United States Patent
Cao

(10) Patent No.: US 8,888,523 B2
(45) Date of Patent: Nov. 18, 2014

(54) EXTENSION APPARATUS FOR POWER OUTLET

(71) Applicants: Hong Fu Jin Precision Industry (ShenZhen) Co., Ltd., Shenzhen (CN); Hon Hai Precision Industry Co., Ltd., New Taipei (TW)

(72) Inventor: Xiang Cao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 31 days.

(21) Appl. No.: 13/709,069

(22) Filed: Dec. 10, 2012

(65) Prior Publication Data

US 2013/0323960 A1 Dec. 5, 2013

(30) Foreign Application Priority Data

Jun. 1, 2012 (CN) ..... 2012 1 0177573

(51) Int. Cl.

| | |
|---|---|
| ***H01R 13/62*** | (2006.01) |
| ***H01R 13/64*** | (2006.01) |
| ***H01R 25/00*** | (2006.01) |
| ***H01R 31/02*** | (2006.01) |

(52) U.S. Cl.

CPC ..... *H01R 25/006* (2013.01); *H01R 31/02* (2013.01)

USPC ..... 439/373; 439/107

(58) Field of Classification Search

USPC ..... 439/373, 535, 956, 518, 638, 107, 145, 439/652

See application file for complete search history.

(56) References Cited

U.S. PATENT DOCUMENTS

| | | | | |
|---|---|---|---|---|
| 4,659,161 | A * | 4/1987 | Holcomb | 439/490 |
| 5,857,875 | A * | 1/1999 | Hsu et al. | 439/652 |
| 6,024,588 | A * | 2/2000 | Hsu et al. | 439/173 |
| 6,699,052 | B1 * | 3/2004 | Poran | 439/172 |
| 6,929,514 | B1 * | 8/2005 | Chuang | 439/652 |
| 7,371,122 | B2 * | 5/2008 | Ivanova et al. | 439/652 |
| D573,950 | S * | 7/2008 | Schwartz | D13/139.1 |
| 7,670,155 | B2 * | 3/2010 | Ortega | 439/107 |
| 8,353,716 | B2 * | 1/2013 | Keswani | 439/355 |
| 2006/0057873 | A1 * | 3/2006 | Ortega | 439/107 |
| 2006/0292924 | A1 * | 12/2006 | Spiri et al. | 439/535 |
| 2007/0287327 | A1 * | 12/2007 | Pejo | 439/535 |

* cited by examiner

*Primary Examiner* — Hae Moon Hyeon

(74) *Attorney, Agent, or Firm* — Novak Druce Connolly Bove + Quigg LLP

(57) ABSTRACT

An extension apparatus of a power outlet includes a main body and a socket. The main body includes a plug portion and an extension plug portion. The plug portion defines three through holes. The extension plug portion defines three blind holes. Three first metal pieces are mounted in the through holes. Three second metal pieces are mounted in the blind holes and coupled to the first metal pieces. The socket is plugged into the extension plug portion to be coupled to the plug portion. When a first plug is plugged into the plug portion, electrical power is fed to a second plug.

8 Claims, 3 Drawing Sheets

EXTENSION APPARATUS FOR POWER OUTLET

BACKGROUND

1. Technical Field

The present disclosure relates to power outlets, and especially to an extension apparatus of a power outlet.

2. Description of Related Art

An extension apparatus of a power outlet includes a plug and a main body connected to the plug through a wire. The main body includes a plurality of plug holes to receive different types of plugs, such as 2-pin plugs and 3-pin plugs. However, the wire may be tangled with the main body when the extension apparatus is not used, and it is inconvenient and time-consuming to untangle the wire from the main body when the extension apparatus needs to be used again.

Therefore, there is room for improvement in the art.

BRIEF DESCRIPTION OF THE DRAWINGS

Many aspects of the present disclosure can be better understood with reference to the following drawing(s). The components in the drawing(s) are not necessarily drawn to scale, the emphasis instead being placed upon clearly illustrating the principles of the present disclosure. Moreover, in the drawing(s), like reference numerals designate corresponding parts throughout the several views.

DETAILED DESCRIPTION

Figure 1:
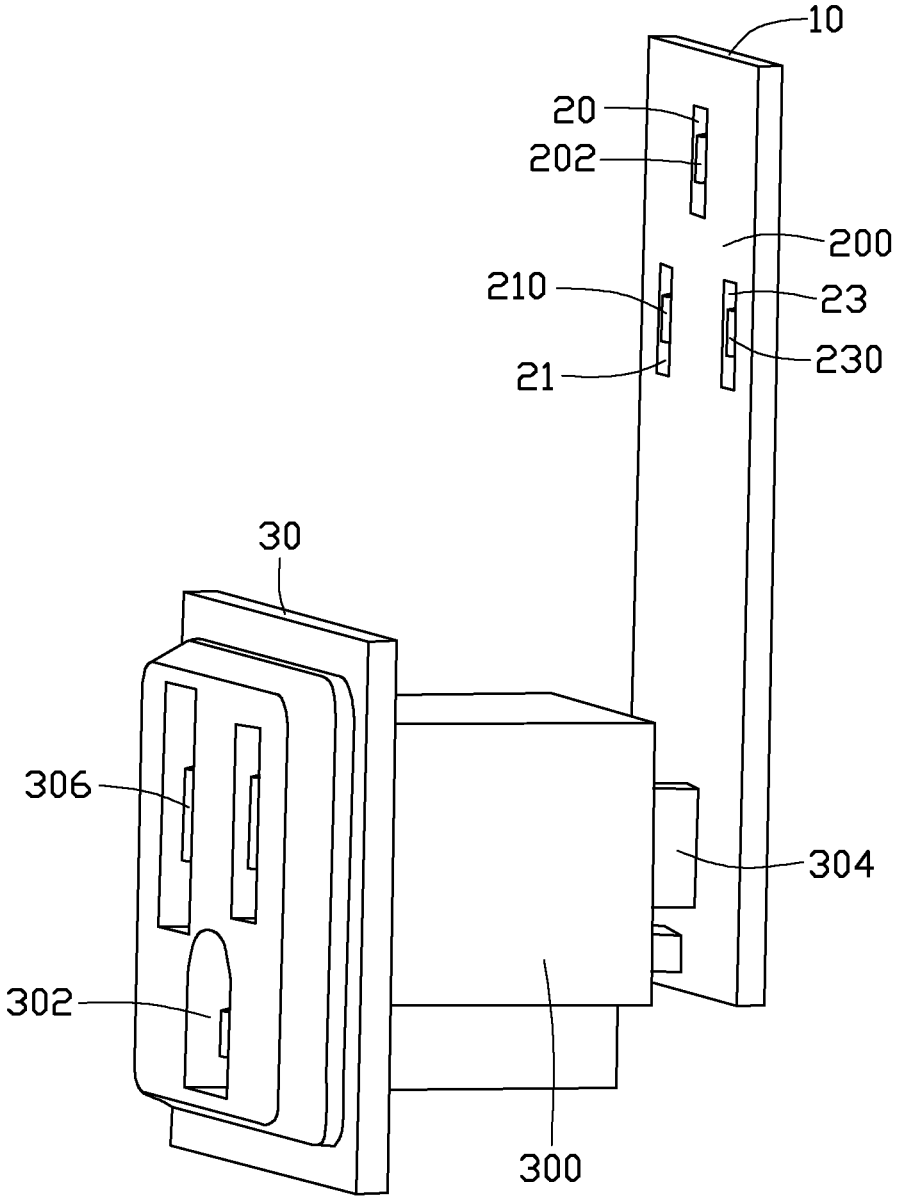
FIG. 1 is an isometric view of an embodiment of an extension apparatus of a power outlet of the present disclosure.
Figure 2:
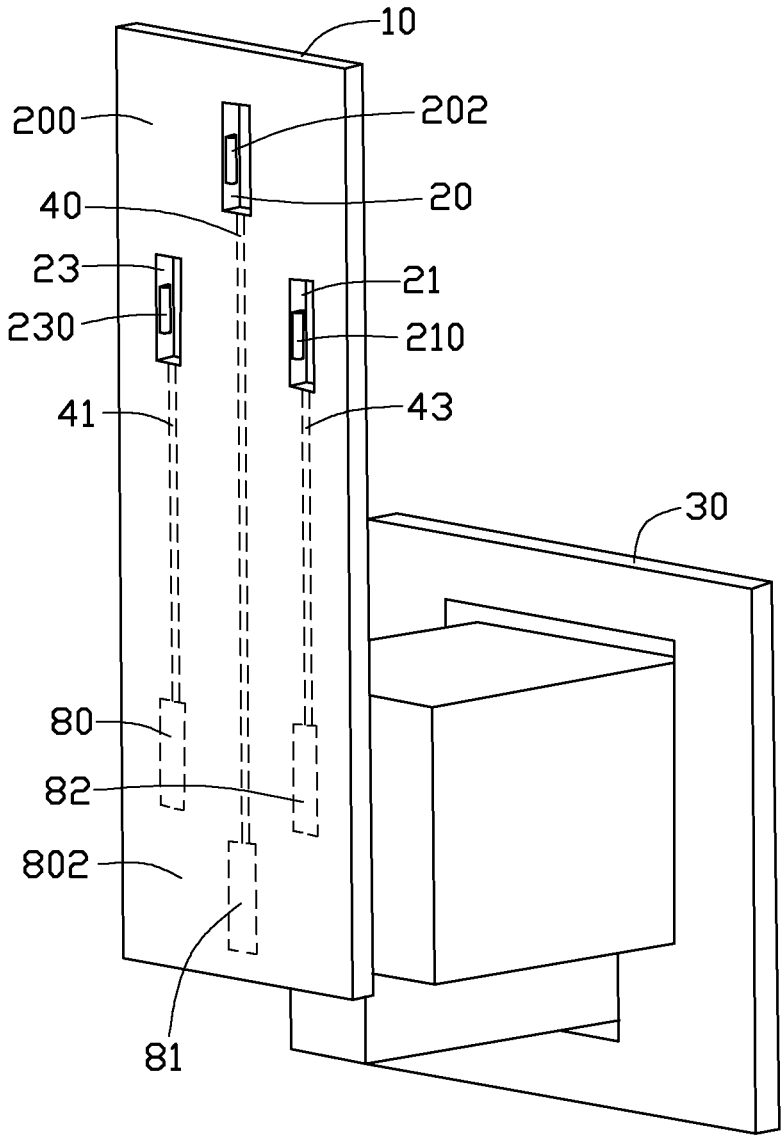
FIG. 2 is similar to FIG. 1, but shown from another perspective.

FIGS. 1 and 2 illustrate an embodiment of an extension apparatus of a power outlet of the present disclosure. The extension apparatus includes a main body 10 and a socket 30. The main body 10 includes a plug portion 200 for connecting a 3-pin plug. The plug portion 200 includes a live metal piece 210, a neutral metal piece 230, and a ground metal piece 202. The main body 10 defines first to third through holes 21, 23, and 20 in a first end, to respectively receive the live metal piece 210, the neutral metal piece 230, and the ground metal piece 202. The main body 10 also defines first to third blind holes 82, 80, and 81 in a surface of the main body 10 and at a second end of the main body 10 opposite to the first end. Three metal pieces (not shown) are arranged in the first to third blind holes 82, 80, and 81. The live metal piece 210 is electrically connected to the metal piece in the first blind hole 82 through a first conductive piece 43. The neutral metal piece 230 is electrically connected to the metal piece in the second blind hole 80 through a second conductive piece 41. The ground metal piece 202 is electrically connected to the metal piece in the third blind hole 81 through a third conductive piece 40. The metal pieces in the first to third blind holes 82, 80, and 81 together form an extension plug portion 802. In other embodiments, the main body 10 can define two through holes and two blind holes, for connecting a 2-pin plug.

The socket 30 includes a base 300 and three pins 304 extending from a first side of the base 300. The base 300 defines three plug holes 302. Three metal pieces 306 are arranged in the three plug holes 302 for connecting a 3-pin plug. The metal pieces 306 are connected to the three pins 304. The three pins 304 are plugged into the first to third blind holes 82, 80, and 81. When the socket 30 is plugged into the extension plug portion 802, the three pins 304 are electrically connected to the three metal pieces 210, 230, and 202 of the plug portion 200 respectively through the three conductive pieces 43, 41, and 40. In other embodiments, the three pins 304 can be welded into the three blind holes 82, 80, and 81 of the extension plug portion 802. In the embodiment, the pins 304 are welded into the base 300.

Figure 3:
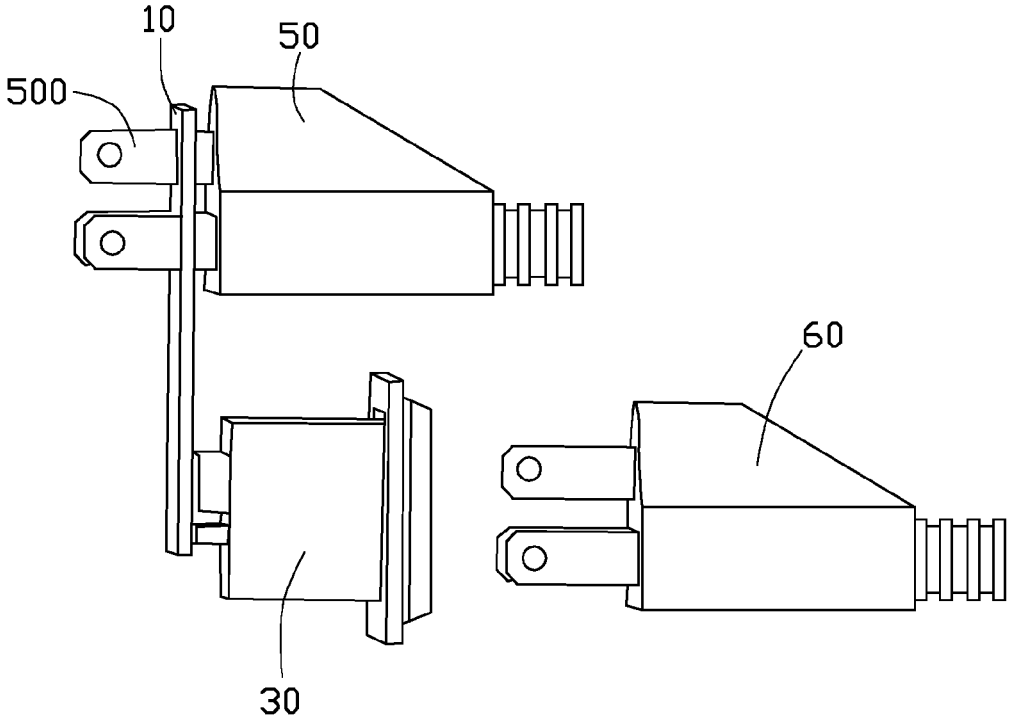
FIG. 3 shows a state of use of the extension apparatus of FIG. 1.

FIG. 3 illustrates a state of use. A first plug 50 extends through the plug portion 200 and is plugged into a power outlet arranged on a wall. Consequently, the three pins 304 of the socket 30 are electrically coupled to the plug 50. At this time, a second plug 60 can be plugged into the plug holes 302 of the socket 30. Thus, the second plug 60 is electrically connected to the three conductive pieces 43, 41, and 40 through the three pins 304 of the socket 30.

In other embodiments, the main body 10 may include a plurality of plug portions, and the number of the socket 30 is increased accordingly.

While the disclosure has been described by way of example and in terms of preferred embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. An extension apparatus of a power outlet, comprising:

a main body, comprising:

a plug portion defining a live through hole and a neutral through hole, wherein two first metal pieces are arranged in the live through hole and the neutral through hole, respectively; and an extension plug portion defining a live blind hole and a neutral blind hole, wherein two second metal pieces are arranged in the live blind hole and the neutral blind hole, respectively, the first metal piece in the live through hole is coupled to the second metal piece in the live blind hole through a first conductive piece, and the first metal piece in the neutral through hole is coupled to the second metal piece in the neutral blind hole through a second conductive piece; and a socket comprising a base, a first pin, and a second pin, wherein the first and second pins are mounted to the base, the base defines a first plug hole and a second plug hole, two third metal pieces are arranged in the first and second plug holes, respectively, and respectively connected to the first pin and the second pin, the first pin and the second pin are respectively engaged in the live blind hole and the neutral blind hole, to be respectively connected to the second metal pieces.

2. The extension apparatus of claim 1, wherein the plug portion further defines a ground hole, the extension plug portion further defines a ground blind hole, another first metal piece is arranged in the ground hole, another second metal piece is arranged in the ground blind hole, the another first metal piece is coupled to the another second metal piece through a third conductive piece.

3. The extension apparatus of claim 2, wherein the base of the socket further defines a third plug hole, and another third piece is arranged in the third plug hole, a third pin is mounted to the base and coupled to the another third piece.

4. The extension apparatus of claim 3, wherein the first to third pins are welded into the base.

5. A power supply apparatus, comprising:

a plug;

main body, comprising:

a plug portion defining a live through hole and a neutral through hole, wherein two first metal pieces are arranged in the live through hole and the neutral through hole, respectively; and an extension plug portion defining a live blind hole and a neutral blind hole, wherein two second metal pieces are arranged in the live blind hole and the neutral blind hole, respectively, the first metal piece in the live through hole is coupled to the second metal piece in the live blind hole through the first conductive piece, and the first metal piece in the neutral through hole is coupled to the second metal piece in the neutral blind hole through a second conductive piece: and a socket comprising a base, the first pin, and the second pin, wherein the first and second pins are mounted to the base, the base defines the first plug hole and the second plug hole, two third metal pieces are arranged in the first and second plug holes, respectively, and respectively connected to the first pin and the second pin, the first pin and the second pin are respectively engaged in the live blind hole and the neutral blind hole, to be respectively connected to the second metal pieces;

wherein the plug extends through the live through hole and the neutral through hole of the plug portion and acquires power, and the extension plug portion and the socket acquire power from the plug.

6. The power supply apparatus of claim 5, wherein the plug portion further defines a ground hole, the extension plug portion further defines a ground blind hole, another first metal piece is arranged in the ground hole, another second metal piece is arranged in the ground blind hole, and the another first metal piece is coupled to the another second metal piece through a third conductive piece.

7. The power supply apparatus of claim 6, wherein the base of the socket further defines a third plug hole, another third piece is arranged in the third plug hole, and the third pin is mounted to the base and coupled to the another third piece.

8. The power supply apparatus of claim 7, wherein the first to third pins are welded into the base.

* * * * *